US007036881B1

(12) United States Patent
Beggs

(10) Patent No.: US 7,036,881 B1
(45) Date of Patent: May 2, 2006

(54) CHAIR SEAT TILT MECHANISM

(75) Inventor: Ken A. Beggs, Waterloo (CA)

(73) Assignee: Leggett & Platt Ltd., Waterloo (CA)

( * ) Notice: Subject to any disclaimer, the term of this patent is extended or adjusted under 35 U.S.C. 154(b) by 817 days.

(21) Appl. No.: 09/611,506

(22) Filed: Jul. 7, 2000

(51) Int. Cl.
*A47C 1/24* (2006.01)

(52) U.S. Cl. ..... 297/300.1; 297/300.5

(58) Field of Classification Search ..... 297/300.5, 297/300.4, 300.2, 300.8, 300.6, 374, 301.1, 297/301.3, 313, 337, 314
See application file for complete search history.

(56) References Cited

U.S. PATENT DOCUMENTS 5,340,194 A * 8/1994 Neumuller ..... 297/374
5,423,594 A * 6/1995 Hancock et al. ..... 297/300.2
5,573,303 A * 11/1996 Doerner ..... 297/300.5
5,577,807 A * 11/1996 Hodge et al. ..... 297/463.1
5,664,834 A * 9/1997 Hsu ..... 297/300.5
5,685,607 A * 11/1997 Hirschmann ..... 297/300.8
5,979,984 A * 11/1999 DeKraker et al. ..... 297/300.5
6,033,021 A * 3/2000 Udo et al. ..... 297/313
6,120,096 A * 9/2000 Miotto ..... 297/300.5

OTHER PUBLICATIONS

"Regular Free Float"; Northfield Metal Products Limited, Ontario, Canada; photographs.

* cited by examiner

*Primary Examiner*—Jerry Redman
(74) *Attorney, Agent, or Firm*—Shook, Hardy & Bacon, L.L.P.

(57) ABSTRACT

The seat plate of a chair control is pivotably mounted to the main frame so as to be tiltable forwardly and rearwardly. An arm extending from the seat plate has a slot which receives a pin of the main frame to limit forward and rearward tilting of the seat plate. The back bracket is configured such that either the forward or the rearward tilting of the seat plate is further limited by abutment with the back bracket, dependent upon the reclining position of the back bracket. However, the seat plate has a range of tilting motion irrespective of the tilt of the back bracket for the chair control.

18 Claims, 7 Drawing Sheets

CHAIR SEAT TILT MECHANISM

BACKGROUND OF THE INVENTION

This invention relates to a chair control and to a chair incorporating a chair control.

In U.S. Pat. No. 5,573,303 to Doerner issued Nov. 12, 1996, a chair control forces the chair seat to tilt forwardly when the backrest is tilted rearwardly. This alleviates circulation problems in an occupant's legs and adjusts the position of the occupant to a more relaxed position. However, an occupant may wish greater control of his or her position.

SUMMARY OF THE INVENTION

In the subject invention, the seat plate of a chair control is pivotably mounted to the main frame so as to be tiltable forwardly and rearwardly. An arm extends from the seat plate and interacts with a stop of the main frame to limit forward and rearward tilting of the seat plate. The arrangement is such that the seat plate has a range of tilting motion irrespective of the tilt of the back bracket for the chair control.

According to the present invention, there is provided a chair control, comprising: a main frame having a stop extending therefrom; a back bracket pivotably mounted to said main frame so as to have a rearward portion tiltable downwardly; a seat plate mounted to said main frame at a main frame pivot so as to be tiltable forwardly and rearwardly regardless of a tilt of said back bracket, said seat plate having an arm extending therefrom such that forward and rearward tilting of said seat plate is limited by interaction of said arm with said stop.

According to another aspect of the invention, there is provided a chair comprising: a chair base; a chair seat; a chair back; a chair control comprising; a main frame mounted to said base, said main frame having a stop extending therefrom; a back bracket mounted to said chair back, said back bracket pivotably mounted to said main frame so as to have a rearward portion tiltable downwardly; a seat plate mounted to said seat, said seat plate mounted to said main frame at a main frame pivot so as to be tiltable forwardly and rearwardly regardless of a tilt of said back bracket, said seat plate having an arm extending therefrom such that forward and rearward tilting of said seat plate is limited by interaction of said arm with said stop.

BRIEF DESCRIPTION OF THE DRAWINGS

In the figures which disclose example embodiments of the invention.

DETAILED DESCRIPTION OF THE PREFERRED EMBODIMENTS

Figure 1:
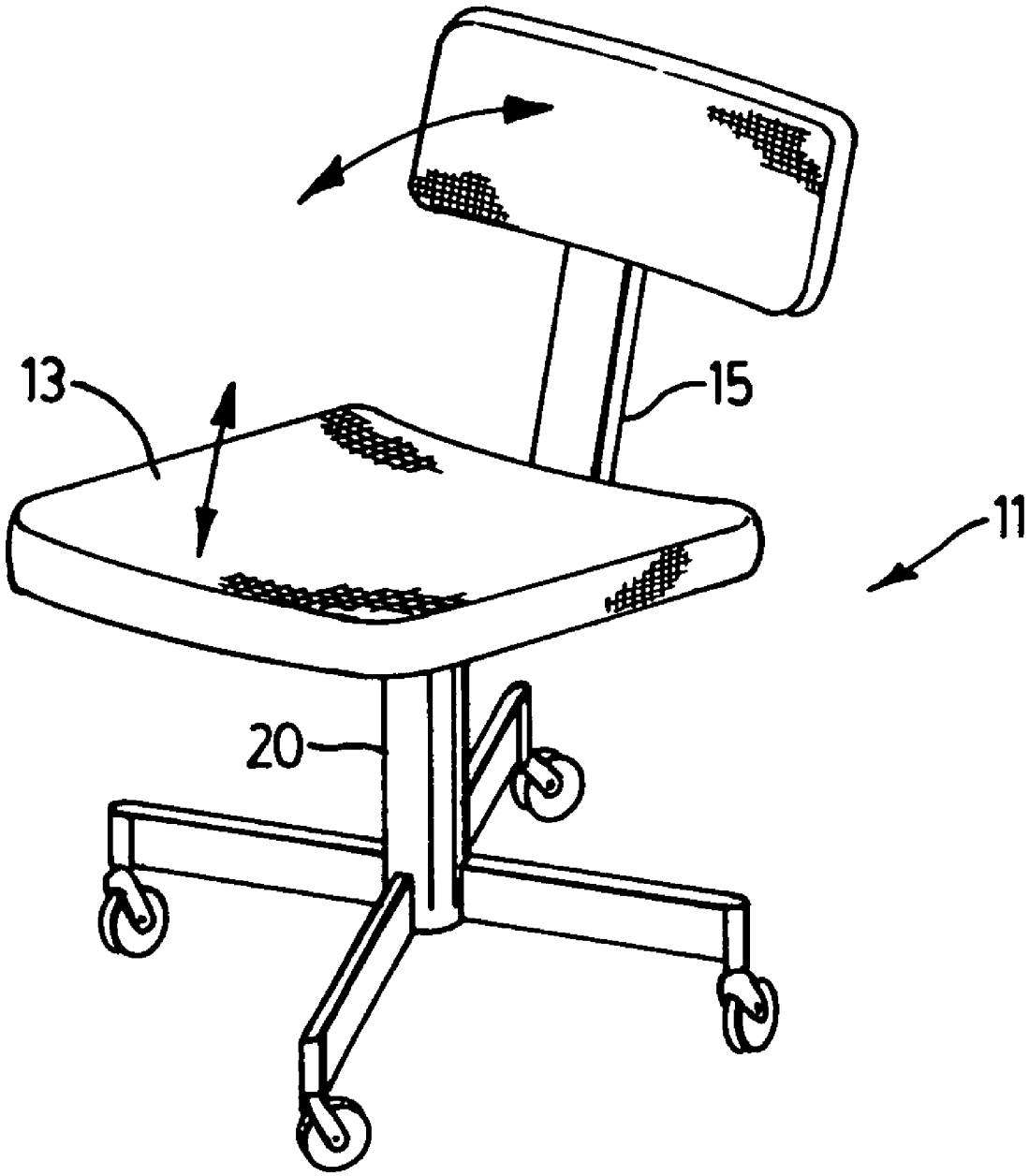
FIG. 1 is a perspective view of a chair with a chair control made in accordance with this invention.
Figure 2:
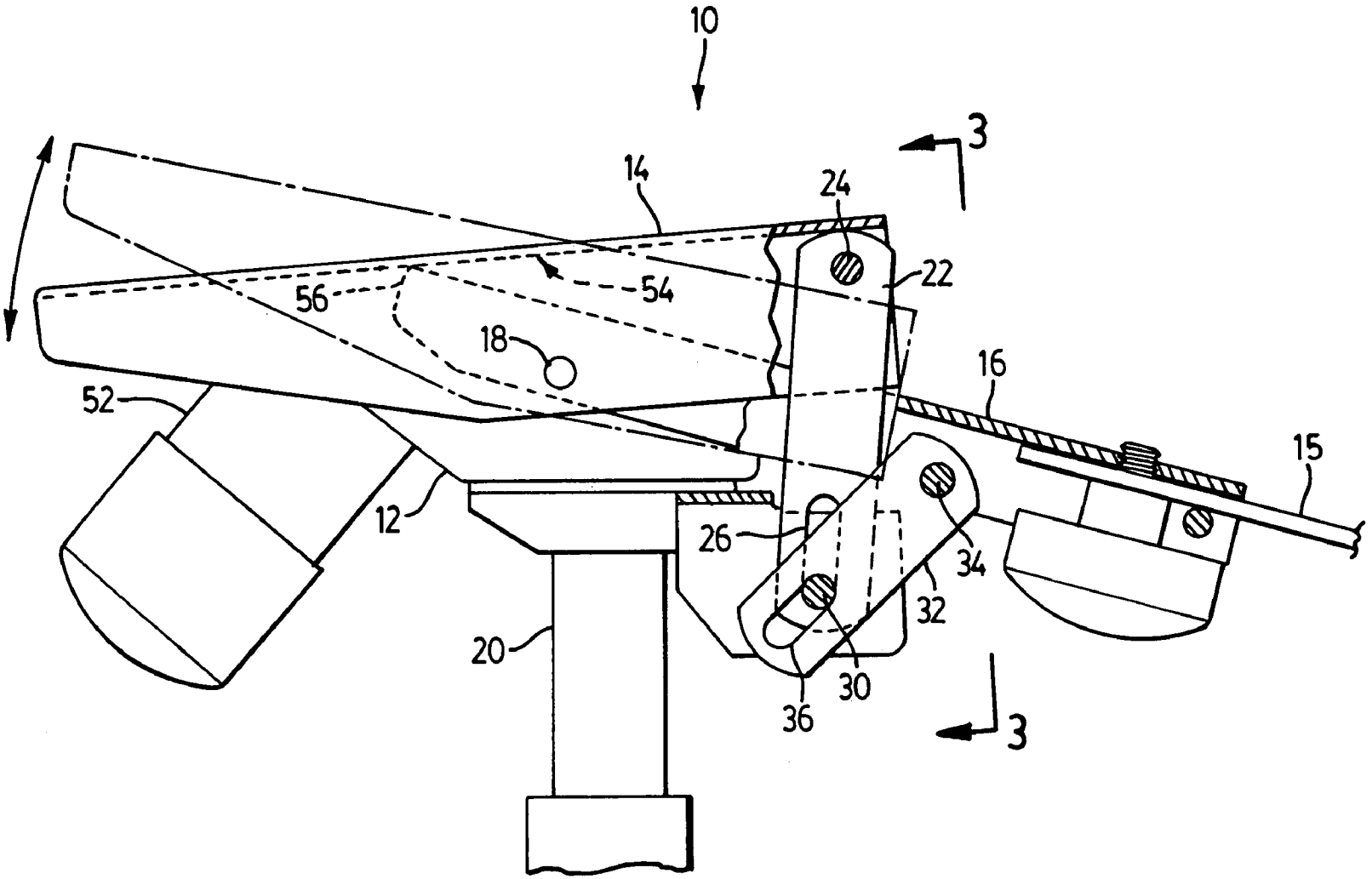
FIG. 2 is a partially broken away and partially sectioned side view of a chair control made in accordance with an embodiment of this invention shown in a first position.

Referencing FIGS. 1 and 2, a chair 11 has a chair control 10 mounted on a spindle base 20 and attached to seat 13 and back 15. Referencing FIGS. 2 and 3, chair control 10 comprises a main frame 12, a seat plate 14, and a back bracket 16. The seat plate 14 and back bracket 16 are pivotably attached to the main frame by main frame pivot 18. The main frame 12 is mounted to spindle 20 of the chair. The chair seat is affixed to seat plate 14 and the back 15 to back bracket 16.

The upper end of an arm 22 is pivotably mounted at the rear of seat plate 14 by seat plate pivot pin 24. The lower end of the arm 22 has a slot 26 which receives a shaft 30 carried by the main frame. A series of arms 32 are pivotably mounted to the back bracket 16 by back bracket pivot pin 34. The lower end of each arm 32 has a slot 36 which receives shaft 30. The arms 32 are interleaved with plate washers 38 received on shaft 30.

A plate 40 fixed to shaft 30 acts as a compression member at one side of arms 32. A sleeve 42 acts as a second compression member at the other side of arms 32. A cam (not shown) can be operated to displace shaft 30 with respect to sleeve 42 so as to draw plate (compression member) 40 toward sleeve (compression member) 42.

A pair of tensioned coil springs 50 is mounted between seat plate pivot pin 24 and shaft 30. In conventional fashion, a tensioned spring (not shown) within housing 52 is mounted between main frame 12 and back bracket 16.

Figure 3:
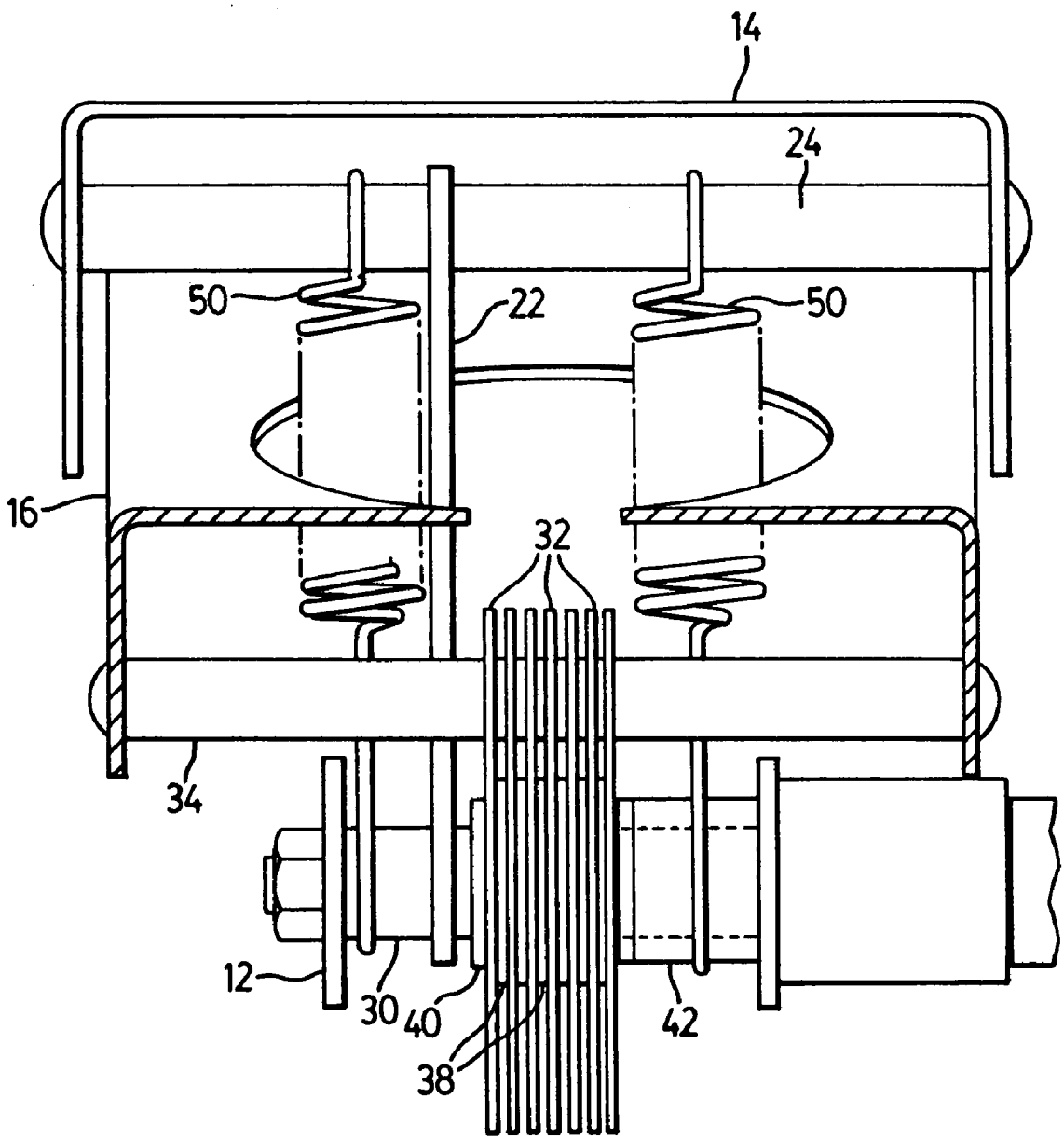
FIG. 3 is a rear view along the lines 2—2 of FIG. 2.
Figure 4:
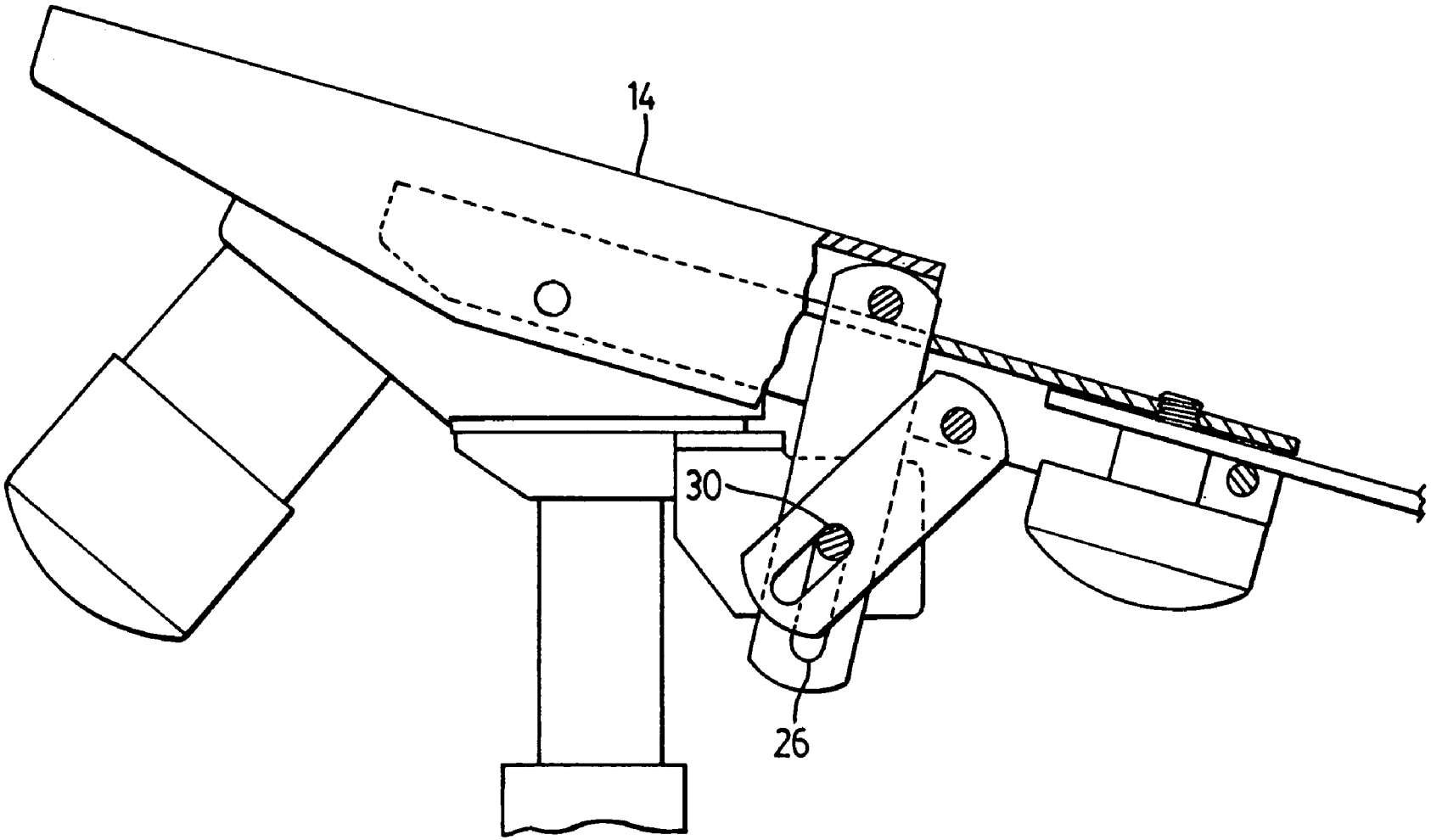
FIG. 4 is a side view of the chair control of FIG. 2 shown in a second position.

With reference to FIGS. 1 to 3, in operation, an occupant of the chair 11 may lean back, overcoming the spring in housing 52, so that the rear portion of back bracket 16 tilts downwardly until the top of slots 36 of back bracket arms 32 abut shaft 30. In this fully reclined position of the back bracket, the occupant may shift his or her weight forwardly or rearwardly to cause the seat plate 14 to tilt forwardly or rearwardly between the solid line and ghost line positions of the seat plate shown in FIG. 2. As shown in FIG. 2, with the back bracket in its fully reclined position, the forward tilting of the seat plate is limited by the under surface 54 of the top portion of seat plate 14 stopping against the nose 56 of back bracket 16. As seen in FIG. 4, with the back bracket in its fully reclined position, the rearward tilting of the seat plate is limited by the top of slot 26 of seat plate arm 22 stopping against shaft 30 of the main frame. Springs 50 (FIG. 3) urge the seat plate 14 toward its fully rearwardly tilted position.

Figure 5:
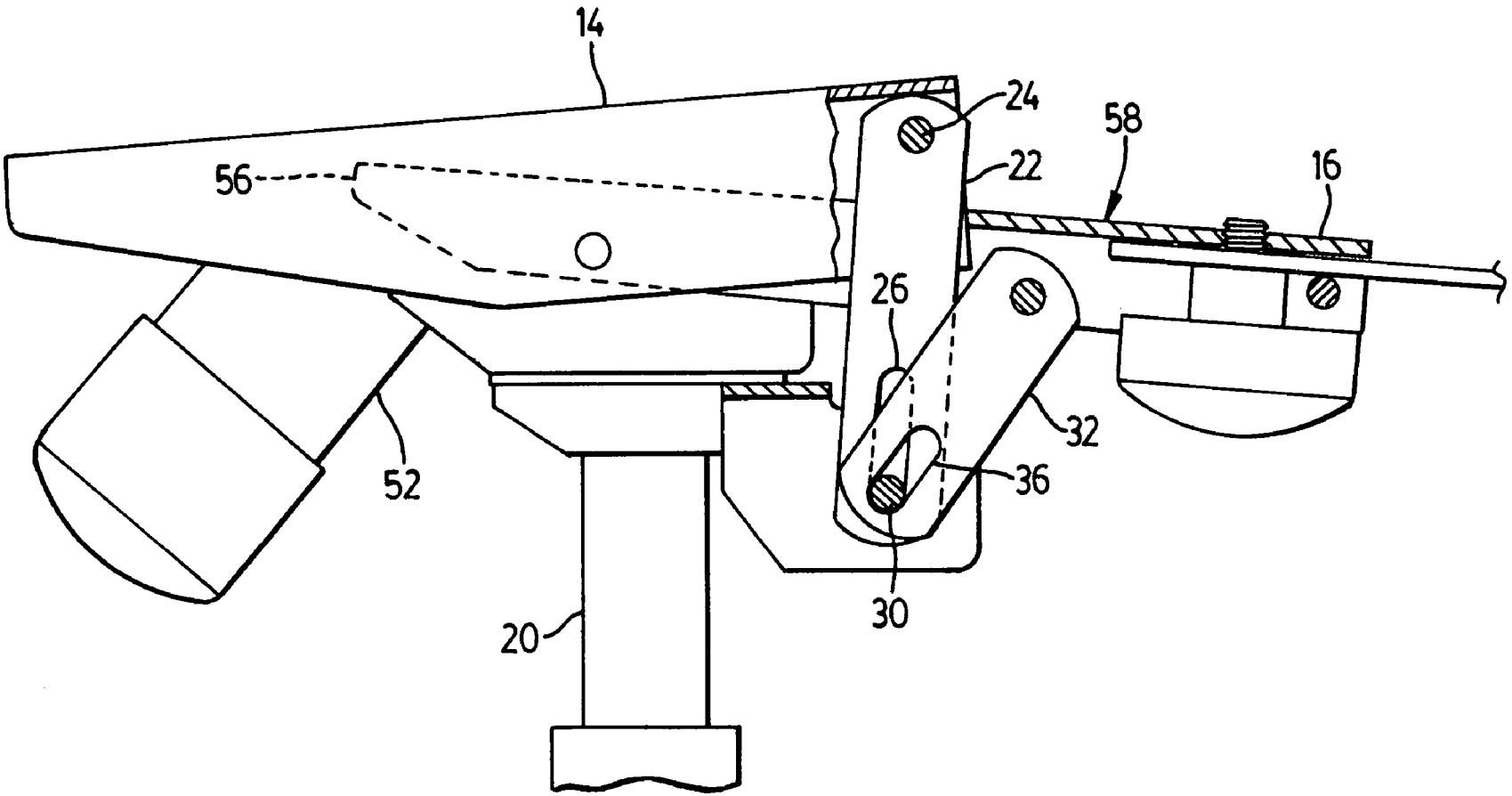
FIG. 5 is a side view of the chair control of FIG. 2 shown in a third position.

If the occupant subsequently leans forwardly in the chair, the rear portion of the back bracket 16 tilts upwardly under the urging of the spring in housing 52 until the lower end of slots 36 of back bracket arms 32 stop against shaft 30, as shown in FIG. 5. In this unreclined position of the back bracket 16, as shown in FIG. 5, the seat plate 14 may tilt forwardly until the bottom of slot 26 stops against shaft 30. With the back bracket in its unreclined position, the seat plat may tilt rearwardly until pivot pin 24 of seat plate arm 22 stops against abutment surface 58 of back bracket 16.

With reference to FIG. 3, the back bracket may be locked in any reclined position by operation of the cam (not shown) which draws compression plate 40 toward sleeve 42 in order to frictionally engage back bracket arms 32 with plate washers 38. It will be noted that with the back bracket locked in position, the seat plate 14 remains free to tilt forwardly and rearwardly.

From the foregoing description, it will be apparent that an absolute limit for forward and rearward tilting of the seat plate 14 is defined by the interaction of the slot 26 in the seat plate arm 22 with the main frame shaft 30, which acts as a stop. However, if the back bracket has been tilted downwardly beyond a certain point, the forward tilting of the seat plate is further limited by the seat plate abutting the nose 56 of the back bracket. And if the back bracket has been moved toward its unreclined position beyond a certain point, the rearward tilting of the seat plate is further limited by the seat plate pivot pin 24 abutting back bracket surface 58. Therefore, by choosing the length of the nose 56 and the maximum spacing between seat plate pivot pin 24 and back bracket surface 58, the range of tilting motion of the seat plate for various positions of the back bracket may be set.

Figure 6:
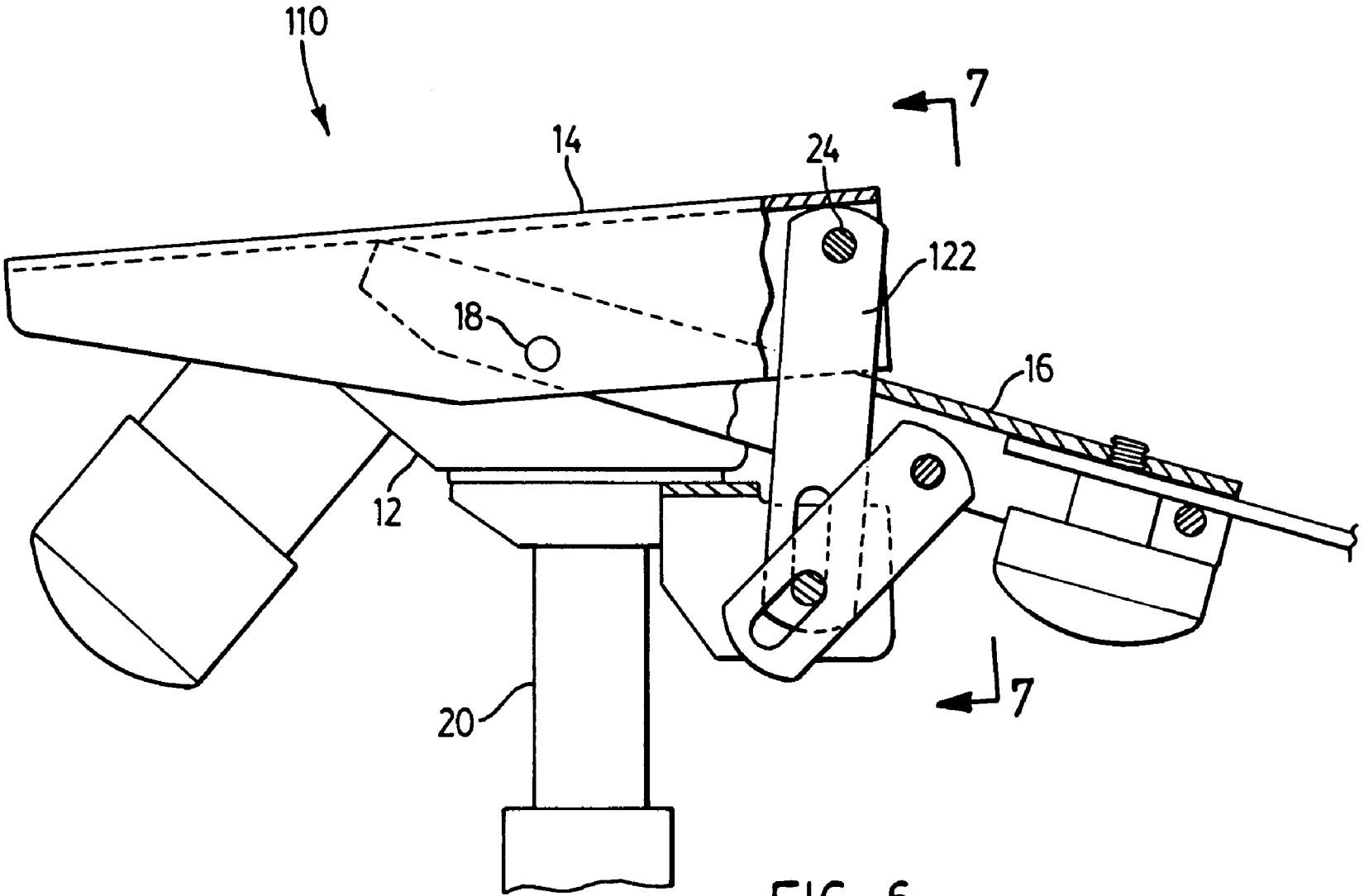
FIG. 6 is a partially broken away and partially sectioned side view of a chair control made in accordance with another embodiment of this invention shown in a first position.
Figure 7:
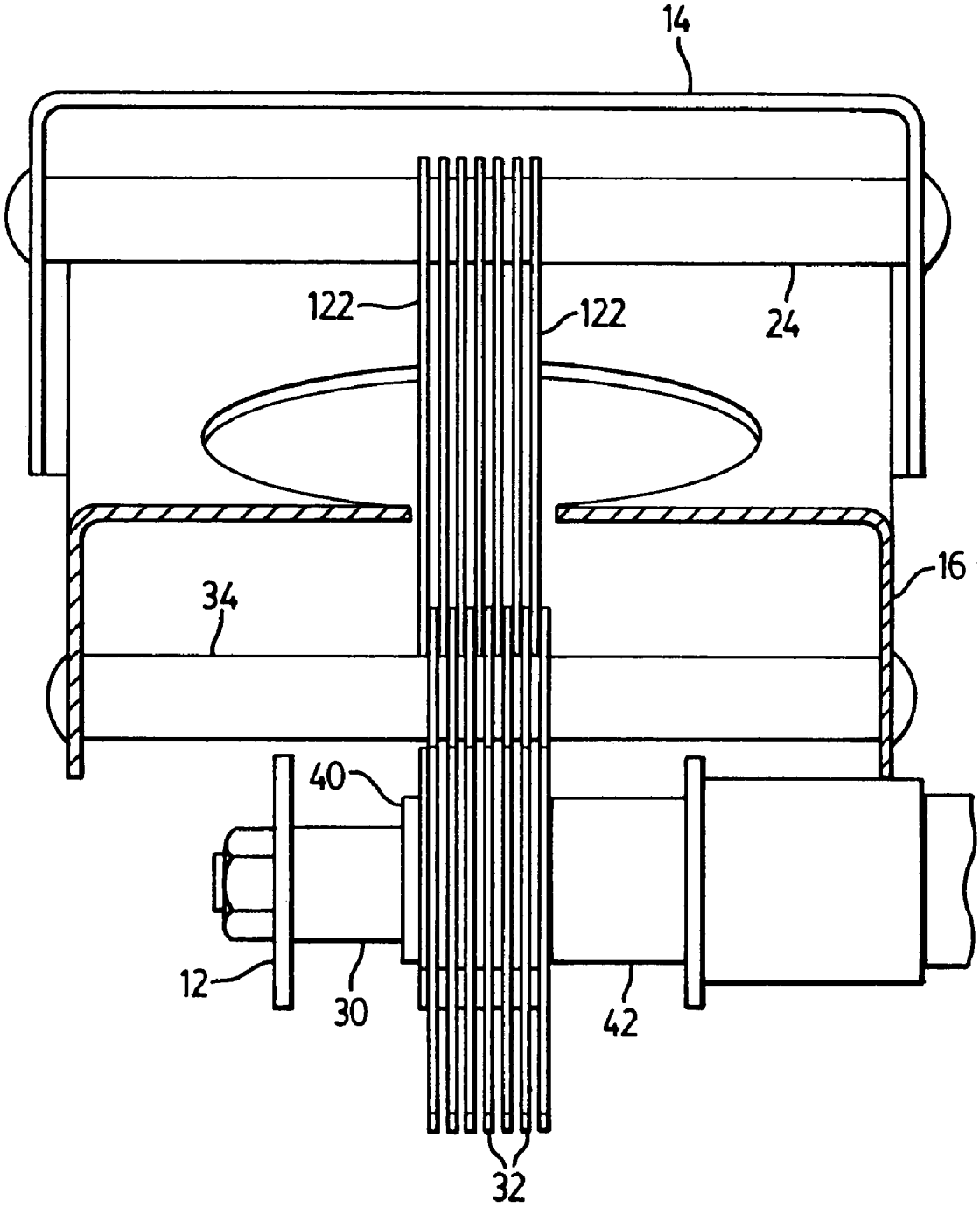
FIG. 7 is a rear view along the lines 7—7 of FIG. 6.

FIGS. 6 and 7 illustrate a second embodiment of a chair control, wherein like parts have like reference numerals. In chair control 110, a series of arms 122 are pivotably attached to seat plate 14 by pivot pin 24. These arms interleave with arms 32 of back bracket 16 at shaft 30. In consequence, when a cam (not shown) moves compression plate 40 toward sleeve 42, arms 32 and 122 are frictionally engaged to lock both the seat plate 14 and back bracket 16 in position. In this manner, an occupant may lock in a desired tilt for the seat and back rest of the chair. In all other respects, the chair control 110 operates in the same fashion as the chair control 10 of FIGS. 2 to 4.

While the absolute limit of the forward and rearward tilt of the seat plate has been described as set by the interaction of arm 22 or arms 122 with shaft 30, other arrangements may be envisaged to accomplish this purpose. For example, an arcuate arm may rigidly depend from seat plate 14 and two spaced fingers extend transversely of the arcuate arm. With this arrangement, the upper finger may abut a pin stop extending from the main frame 12 to define the maximum rearward tilt of the seat plate and the lower arm abut the seat plate to define the maximum forward tilt of the seat plate.

While the nose 56 and abutment surface 58 have been described as the features of the back bracket which may further limit forward or rearward tilting of the seat plate, the back bracket could be configured so that it has other features which provide these further limitations. For example, the back bracket may have upward protrusions which, dependent upon the reclined position of the back bracket, the seat plate may abut as it tilts forwardly or rearwardly.

Other modifications will be apparent to those skilled in the art and, therefore, the invention is defined in the claims.

What is claimed is:

1. A chair control, comprising:

a main frame having a stop extending therefrom;

a back bracket pivotably mounted to said main frame so as to have a rearward portion tiltable downwardly;

a seat plate mounted to said main frame at a main frame pivot so as to be tiltable forwardly and rearwardly regardless of a tilt of said back bracket, said seat plate having an arm extending therefrom such that forward and rearward tilting of said seat plate is limited by interaction of said seat plate arm with said stop;

wherein said back bracket terminates at a nose extending sufficiently forwardly of said main frame pivot that, at least when said back bracket is tilted downwardly so that said stop stops further rearward tilting, said nose limits forward tilting of said seat plate.

2. The chair control of claim 1 wherein said back bracket has an abutment such that, at least when said back bracket is not tilted downwardly, said abutment limits rearward tilting of said seat plate.

3. The chair control of claim 2 wherein said seat plate arm is mounted to said seat plate at a pivot.

4. The chair control of claim 3 wherein said stop is a shaft and said seat plate arm has a slot receiving said shaft.

5. The chair control of claim 4 wherein said back bracket arm is pivotably mounted to said back bracket, said back bracket arm having a slot receiving said shaft such that downward tilting of said back bracket is limited by interaction of said slot of said back bracket with said shaft.

6. The chair control of claim 5 wherein said seat plate arm is one of a plurality of like seat plate arms and wherein said back bracket arm is one of a plurality of like back bracket arms, said seat plate arms being interleaved with said back bracket arms and further comprising a pair of compression members for compressing said arms together in order to lock said back bracket and said seat plate in position.

7. The chair control of claim 5 wherein said back bracket arm is one of a plurality of like back bracket arms, said back bracket arms being interleaved with friction plates carried by said shaft and further comprising a pair of compression members for compressing said arms and friction plates together in order to lock said back bracket in position.

8. The chair control of claim 5 wherein said back bracket is pivotably mounted to said main frame at said main frame pivot.

9. The chair control of claim 5 including a spring to bias said seat plate toward a rearward tilted position.

10. A chair comprising:

a chair base;

a chair seat;

a chair back;

a chair control comprising;

a main frame mounted to said base, said main frame having a stop extending therefrom;

a back bracket mounted to said chair back, said back bracket pivotably mounted to said main frame so as to have a rearward portion tiltable downwardly;

a seat plate mounted to said seat, said seat plate mounted to said main frame at a main frame pivot so as to be tiltable forwardly and rearwardly regardless of a tilt of said back bracket, said seat plate having an arm extending therefrom such that forward and rearward tilting of said seat plate is limited by interaction of said seat plate arm with said stop.

wherein said back bracket terminates at a nose extending sufficiently forwardly of said main frame pivot that, at least when said back bracket is tilted downwardly so that said stop stops further rearward tilting, said nose limits forward tilting of said seat plate.

11. The chair of claim 10 wherein said back bracket has an abutment such that, at least when said back bracket is not tilted downwardly, said abutment limits rearward tilting of said seat plate.

12. A chair control, comprising:

a main frame having a stop extending therefrom;

a back bracket pivotably mounted to said main frame so as to have a rearward portion tiltable downwardly;

a seat plate pivotably mounted to said main frame at a main frame pivot, said seat plate tiltable forwardly and rearwardly independently of tilting of said back bracket;

said seat plate having an arm extending therefrom such that forward and rearward tilting of said seat plate is limited by interaction of said arm with said stop;

said back bracket terminating at a nose extending sufficiently forwardly of said main frame pivot that, at least when said back bracket is tilted downwardly past a pre-determined point, said nose further limits forward tilting of said seat plate.

13. The chair control of claim 12 wherein said back bracket has an arm extending therefrom such that downward tilting of said back bracket is limited by interaction of said back bracket arm with said stop.

14. The chair control of claim 13 wherein wherein said stop is a shaft and wherein said back bracket arm is pivotably mounted to said back bracket, said back bracket arm having a slot receiving said shaft such that downward tilting of said back bracket is limited by interaction of said slot of said back bracket with said shaft.

15. The chair control of claim 12 wherein said back bracket has an abutment such that, at least when said back bracket is not tilted downwardly, said abutment limits rearward tilting of said seat plate.

16. The chair control of claim 12 wherein said seat plate arm is mounted to said seat plate at a pivot.

17. The chair control of claim 16 wherein said stop is a shaft and said seat plate arm has a slot receiving said shaft.

18. The chair control of claim 12 wherein said back bracket is pivotably mounted to said main frame at said main frame pivot.

* * * * *